United States Patent [19]

Becker

[11] Patent Number: 4,580,494

[45] Date of Patent: Apr. 8, 1986

[54] DEVICE FOR CONVERTING A SHEET TURN-OVER DEVICE SELECTIVELY FOR FIRST-FORM PRINTING AND FIRST-FORM PERFECTOR PRINTING

[75] Inventor: Willi Becker, Bammental, Fed. Rep. of Germany

[73] Assignee: Heidelberger Druckmaschinen AG, Heidelberg, Fed. Rep. of Germany

[21] Appl. No.: 628,245

[22] Filed: Jul. 6, 1984

[30] Foreign Application Priority Data

Jul. 6, 1983 [DE] Fed. Rep. of Germany ... 8319431[U]

[51] Int. Cl.[4] ..... B41F 5/02

[52] U.S. Cl. ..... 101/230; 101/246

[58] Field of Search ..... 101/174, 230, 231, 232, 101/409, 410, 222, 223, 229, 246; 271/277, 82, 69, 80, 225, DIG. 9

[56] References Cited

U.S. PATENT DOCUMENTS

| | | | |
|---|---|---|---|
| 2,757,610 | 8/1956 | Gegenheimer et al. | 101/230 X |
| 3,768,406 | 10/1973 | Gutsche et al. | 101/246 |
| 3,782,280 | 1/1974 | Surny et al. | 101/246 |
| 3,985,074 | 10/1976 | Bonsch | 101/246 |
| 4,024,814 | 5/1977 | Becker | 101/230 |
| 4,120,244 | 10/1978 | Wirz | 101/409 |
| 4,378,734 | 4/1983 | Wirz | 101/230 |
| 4,444,106 | 4/1984 | Frenzel et al. | 101/230 |

FOREIGN PATENT DOCUMENTS

| | | | |
|---|---|---|---|
| 2045926 | 3/1972 | Fed. Rep. of Germany | 101/409 |
| 2045213 | 10/1980 | United Kingdom | 101/230 |

OTHER PUBLICATIONS

"Mechanism & Actuator for Clamping Sheets on a Drum" IBM Tech. Discl. Bulletin, vol. 23, No. 7A, Dec. 1980, pp. 2679–2682.

*Primary Examiner*—E. H. Eickholt

*Attorney, Agent, or Firm*—Herbert L. Lerner; Laurence A. Greenberg

[57] ABSTRACT

A device for selectively converting, for either first-form alone or combined first-form and perfector printing, a turn-over device arranged between individual printing units of a sheet-fed rotary printing machine, including adjustment elements for the turn-over device, and hydraulically actuable control and clamping devices operatively connected with the turn-over device for performing controlling and clamping operations on the respective adjustment elements.

12 Claims, 7 Drawing Figures

Fig. 5
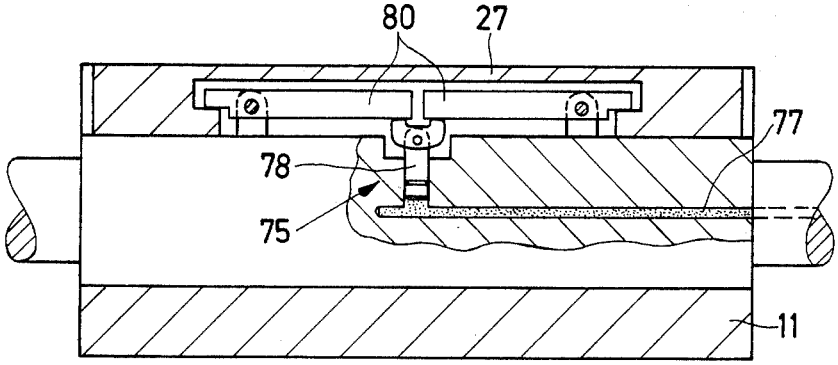
Fig. 6
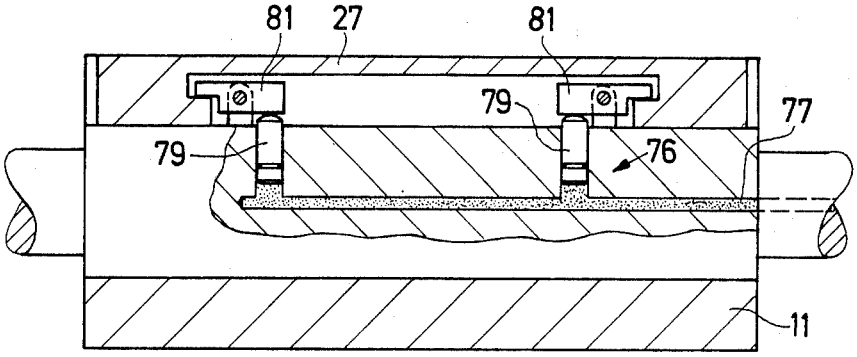
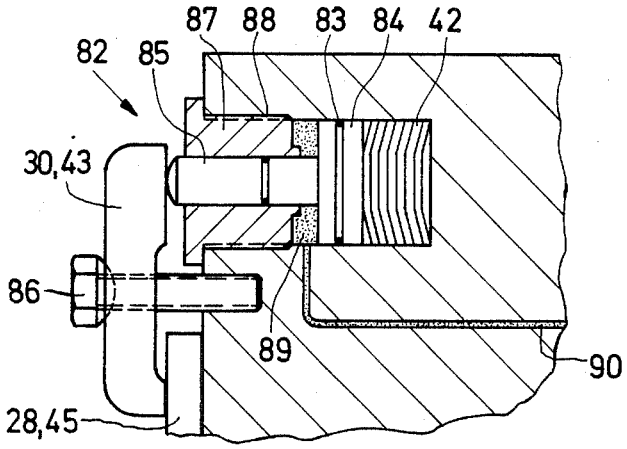
Fig. 7

DEVICE FOR CONVERTING A SHEET TURN-OVER DEVICE SELECTIVELY FOR FIRST-FORM PRINTING AND FIRST-FORM PERFECTOR PRINTING

SPECIFICATION

The invention relates to a device for converting a sheet turn-over device located between individual printing units of a sheet-fed rotary printing machine selectively for one-side (first-forme) printing or both one-side (first forme) and perfector printing.

The actual state of art encompasses almost exclusively converting and adjusting mechanisms, respectively, with purely mechanical operating methods.

As examples to this effect, German Pat. Nos. 24 19 747 and 24 60 503 are cited, which already reveal the efforts and endeavors undertaken to combine various operating phases in order to make the entire conversion process more comprehensible and to make the management or application thereof more reliable.

In addition to considerable advantages which are attainable thereby, the occurrence of operating errors cannot nevertheless, be excluded completely, especially in the case of the releasing of the clamping connections of the adjustment which is to be effected in proper sequence, as well as the reclamping of those clamping connections.

Therefore, in spite of the combination of several conversion and adjustment activities, the disadvantages due to time and energy-consuming clamping by means of socket wrenches and other tools cannot be avoided. Moreover, the risk of damage to the machine caused by not tightening or insufficiently tightening screws must not be underestimates, as well as the fact which must be taken into consideration that remote control of the clamping points, especially, is not possible.

German Published Non-Prosecuted Application (DE-OS) No. 31 36 349 described a device for adjusting the drive of first-forme (one-side) and perfecting machines. With the aim to reduce the downtime caused by the conversion operation in a way that the adjustment of the drive mechanism is carried out without having to remove the casing of the machine, this German application suggests that, for the purpose of clamping the double gear used for the necessary phase displacement, adjustment elements hydraulically actuable from the outside be provided through which the torsion-proof connection between the first and the second gear is attainable and releasable.

With such a background of this state of art, it is accordingly an object of the invention of the instant application to provide a converting device of the foregoing type which further reduce considerably the aforementioned downtimes and, in addition thereto, offers to the operator a simpler and, above all, safer conversion operation, which is achieved particularly due to the fact that the various conversion operations are determinable in correct sequence.

With the foregoing and other objects in view, there is provided, in accordance with the invention, a device for selectively converting, for either first-forme alone or combined first-forme and perfector printing, a turn-over device arranged between individual printing units of a sheet-fed rotary printing machine, comprising adjustment elements for the turn-over device, and hydraulically actuable control and clamping devices operatively connected with the turn-over device for performing controlling and clamping operations on the respective adjustment elements.

In accordance with another feature of the invention, the control and clamping devices include mechanical operating means for clamping the adjustment elements for the printing operation, and hydraulic operating means for releasing the clamping of the adjustment elements preparatory to effecting a conversion of the turn-over device.

In accordance with a further feature of the invention the mechanical operating means are self-acting.

In accordance with an additional feature of the invention, the hydraulic operating means are operative for clamping and controlling the adjustment elements for the printing process, and including means for releasing clamping by relieving the hydraulic pressure.

In accordance with an added feature of the invention, there is provided a central switching means via which the hydraulically actuable control and clamping devices are operable and are controllable in a give sequence.

In accordance with yet another feature of the invention, there is provided a single control line extending from the central switching means and connected to the hydraulic operating means for initiating the first-forme and perfector printing conversion and for format adjustment.

In accordance with yet a further feature of the invention, there is provided separate control lines extending from the central switching means and connected to the hydraulic operating means for initiating the first-forme and perfector printing conversion and for format adjustment.

In accordance with yet an additional feature of the invention, the turn-over device is a cylinder having a twin wheel connected thereto having a gear and a gear rim disposed thereon, and including a cylinder piston for clamping twin wheel, piston having a piston rod actuable via a thrust member upon clamping jaws serving as levers for pressing said gear rim against an end face of the gear.

In accordance with yet an added feature of the invention, there are provided spring elements via which the clamping force for clamping the twin wheel of the turn-over cylinder is applied, and a pressure chamber having an hydraulic control line connected thereto for releasing the clamping of the twin wheel.

In accordance with an alternate feature of the invention, there are provided grippers carried by the turn-over device, and means for adjusting swinging movement and opening and closing behavior of the grippers, the adjusting means comprising a carriage axially slideable on the turn-over device.

In accordance with a further aspect of the invention, there are provided single-acting cylinder pistons for clamping the carriage of the turn-over device, the cylinder pistons having piston rods and clamping heads secured at respective ends thereof via which the carriage is pressable against the turn-over device.

In accordance with an additional aspect of the invention, there are provided spring elements for applying spring force for clamping the carriage, and a pressure chamber having an hydraulic control line connected thereto for counteracting the spring force.

In accordance with an added aspect of the invention, there are provided clamping jaws for the clamping of the carriage, plungers actuable by separate control lines being cooperatively engageable with the clamping jaws for forming a force-locking connection between the carriage and the turn-over device.

In accordance with yet another aspect of the invention, there are provided respective discs mounted adjacent end faces of a delivery cylinder disposed upstream of the turn-over device in travel direction of the sheets, the discs servicing for adjusting a cam of the delivery cylinder and for format adjustment of a suction device on the delivery cylinder, respectively, and single-action clamping units actuable via clamping straps acting as levers for clamping the respective discs.

In accordance with yet a further aspect of the invention, there are provided spring elements in biasing engagement with a piston via which a clamping force is applicable for clamping the discs, and including a pressure chamber having an hydraulic control line connected thereto for releasing the clamping of the discs.

In accordance with yet an additional aspect of the invention, there is provided a double-acting hydraulic cylinder for axially displacing the carriage parallel to a longitudinal axis of the turn-over device, the cylinder having a piston actuable upon the carriage via a lever secured to the carriage.

In accordance with a concomitant feature of the invention, a delivery cylinder is disposed upstream of the turn-over device in travel direction of the sheets, and including an arresting device for securing part of the delivery cylinder in connection with a format adjustment of the machine, the arresting device comprising a cylinder piston formed with an end recess engageable over a mandrel extending from the delivery cylinder, the piston being actuable at one side thereof by hydraulic fluid receivable in an hydraulic chamber at the side from an hydraulic control line connected therewith and, upon release of pressure from the hydraulic fluid, being biased by spring force of a compression spring acting on the other side of the piston for urging said end recess of the piston about the mandrel.

The benefits of the device incorporating the features of the invention are apparent. All clamping and releasing operations can be controlled from a central location. Moreover, the clamping forces are always constant and determinable and the clamping operations protectable, for example, via an oil-pressure control or monitoring device. The control of the conversion or change-over activities in correct sequence is easily achieved. In addition to the fact that, in the last analysis, the risk of damage to the machine caused by not tightening or insufficiently tightening the clamping screws can be practically excluded, there remains a number of additional benefits offered by the device developed in accordance with the principles of the invention of the instant application.

Other features which are considered as characteristic for the invention are set forth in the appended claims.

Although the invention is illustrated and described herein as embodied in a device for converting a sheet turn-over device selectively for first-forme printing and first-forme perfector printing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIGS. 5 and 6 are sectional views of two additional embodiments of the device for clamping the carriage or slide of the turn-over cylinder; and FIG. 7 is another fragmentary view of FIG. 2 showing a different embodiment a clamping device for the toothed segment of the delivery cylinder and for format adjustment of the suction bar.

Figure 1:
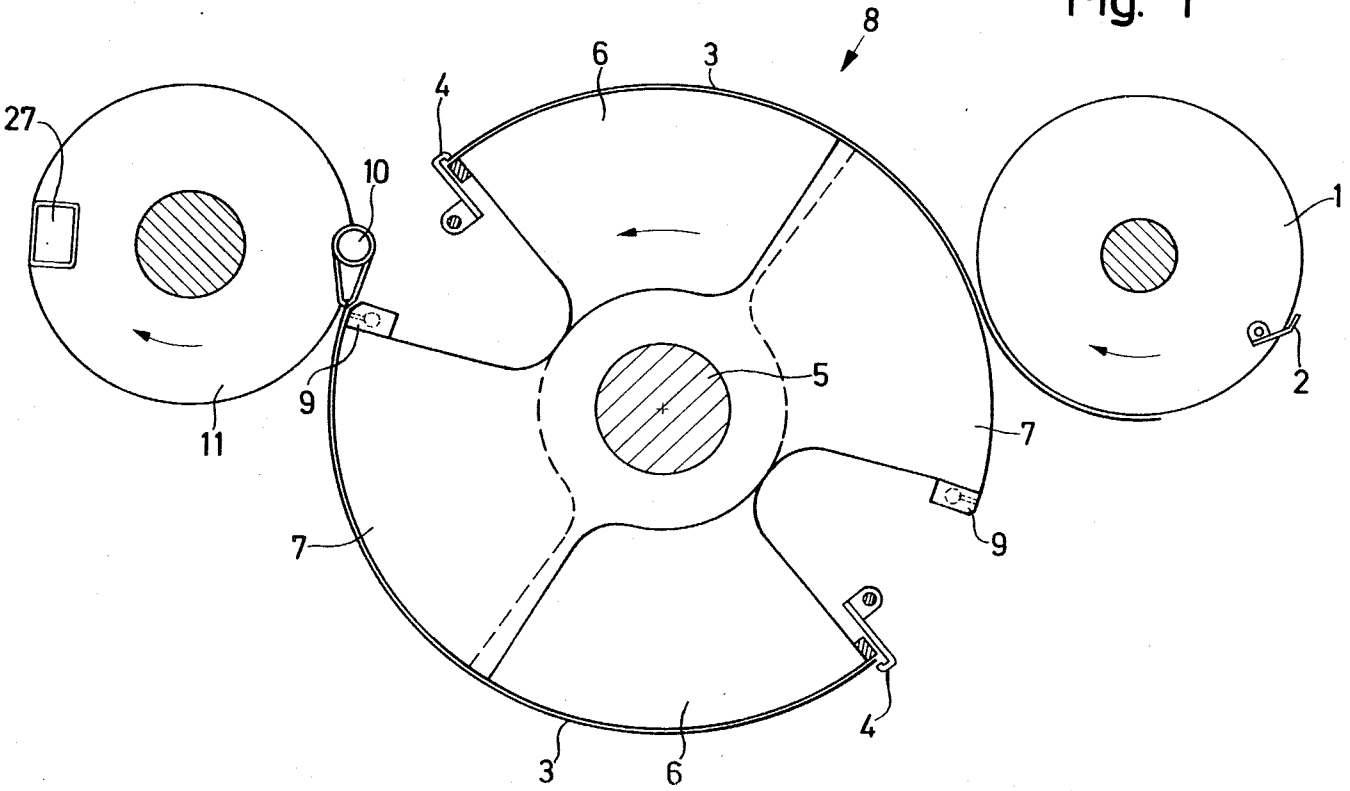
FIG. 1 is a diagrammatic vertical sectional view of a sheet turn-over device according to the invention.

Referring now to the drawing and first, particularly, to FIG. 1 thereof, there are shown sheet transfer stations between individual printing units of a rotary sheet printing machine operating with single side or first-forme printing and with both first forme and perfector printing.

To this effect, a gripper bar 2 of a guiding drum 1 takes over the paper sheet and transfers it to a gripper bar 4 of a delivery cylinder 8 formed of anterior sheet supporting segments 6 rigidly connected to the shaft 5 against rotation relative thereto, and posterior sheet supporting segments 7 rotatably and arrestably mounted on the shaft 5. The trailing edge of each paper sheet 3 is held and tightened or stretched by suction devices 9 until, during the turn-over operation, they are seized by the pivotable tongs grippers 10 of a turn-over cylinder 11 and thereby the sheet 3 is transported farther to the next following pinting unit.

Figure 2:
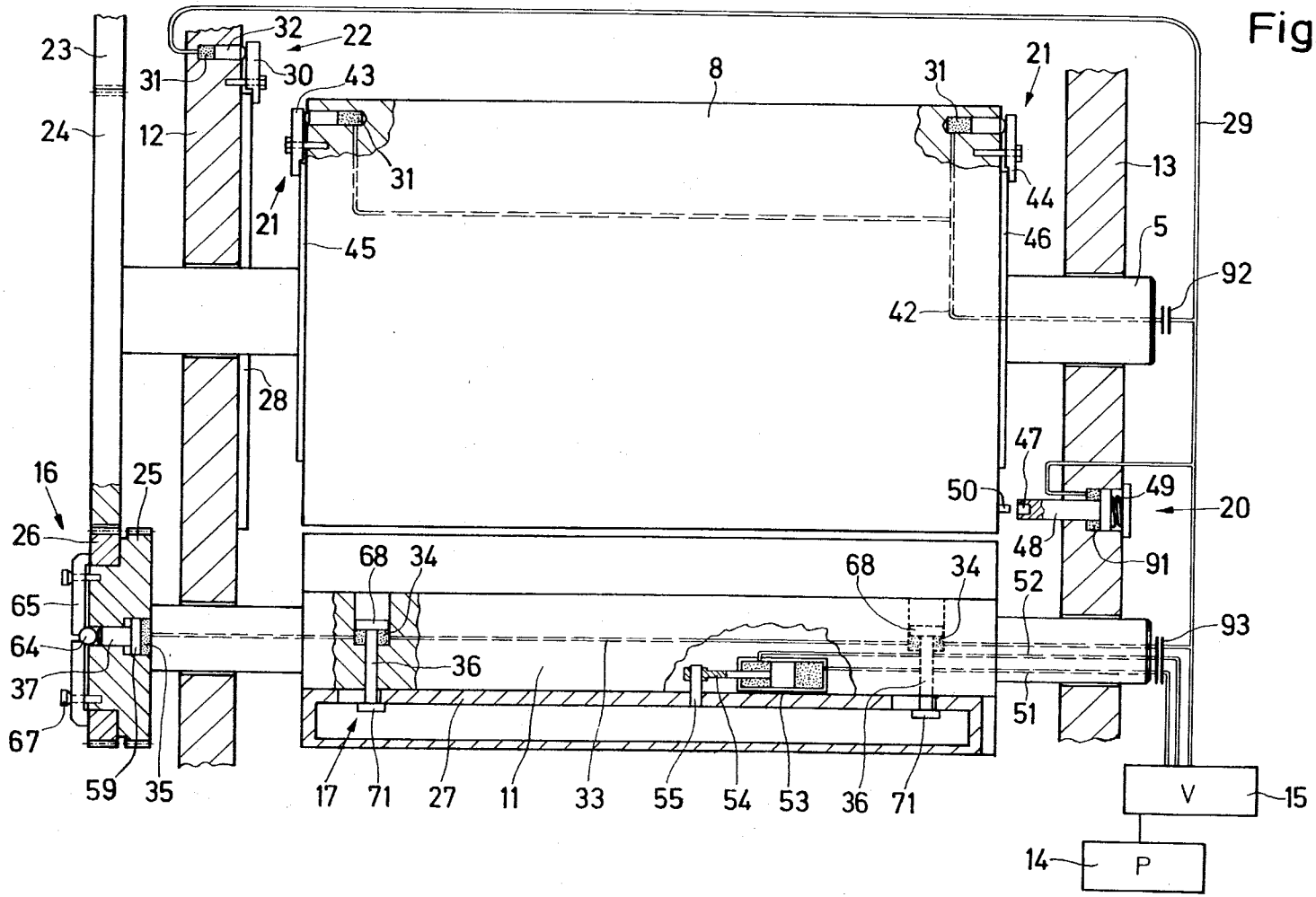
FIG. 2 is a diagrammatic plan view, partly in section and partly schematic, of FIG. 1 showing the devices used at the delivery and turn-over cylinders.

The diagrammatic representation in FIG. 2 is a plan view of the delivery cylinder 8 and the turn-over cylinder 11 supported in lateral walls 12 and 13 of the printing machine, together with appertaining hydraulically actuated switching or controlling and clamping devices 14–17, 20–22, 38, 39, 75, 76 and 82.

The drive of the two cylinders 8 and 11 is effected, initially via a drive wheel 23 of the preceding printing unit and is continuously transmitted through a drive wheel 24 of the delivery cylinder 8, to a gear rim 26 which, via a clamping device 16 is non-positively connected i.e. by force-locking effect, with a toothed wheel or gear 25 of the sheet turn-over cylinder 11.

On the turn-over cylinder 11, there is arranged a device 27 which is axially displaceable and arrestable in the respective position thereof shown in FIG. 2. In the illustrated embodiment of FIG. 2, this device 27 may be, for example, a turn-over cylinder carriage or slide, through which the swiveling movement and the gripper opening and closing behavior of the swiveling tongs grippers 10 which are shown only in FIG. 1, are controllable and adjustable, respectively, for the purpose of taking over the paper sheets in first-forme printing and perfector printing, respectively. The various courses of movement of the tongs grippers 10 which swivel relative to the rotational movement of the turn-over cylinder 11 are achieved for the selective single side or first-forme printing and first-forme and perfector printing, respectively, by axially i.e. in the longitudinal direction of the cylinder, adjacently arranged gripper-control cams, which, for the sake of simplicity, are not illustrated in the drawings, but which control the movements of the two grippers of each tongs grippers 10 through toothed segments and pinions. In order to assure that, through the intermediary of the turn-over cylinder carriage 27, the coordination of the respective necessary control cam for the swiveling movement of the toothed segments and, hence, also for the swiveling movement of the tongs grippers 10 can be effective, this turn-over cylinder carriage 27 is required to be axially displaceable.

Whenever the first-forme and perfector printing procedure is selected, like the gripper devices 10 of the turn-over cylinder 11, the gripper opening and closing behavior of the gripper row 4 must be adjusted with respect to the leading edge of the sheet on the delivery cylinder 8 (retarded gripper opening). This occurs by adjusting a toothed disk 28 which may, for example, be turned by a non-illustrated adjusting pinion and, accordingly, the gripper locking cam fixed thereon brought into the new position.

In order to explain the functional interrelationships further, special reference may be made to German Patents which describe in great detail such purely mechanically operating reversing and adjusting devices for the change-over from solely first-forme printing 20 both first-forme and perfector printing.

The improvements which are employed in the turn-over proposed as a preferred embodiment of the invention are described hereinafter in detail.

In this regard, it should be mentioned that basically in all change-over or conversion operations, the two alternative and also represented embodiments are applicable.

Thus, the clamping of the change-over elements can be effected mechanically, such as by means of spring elements, and the releasing can be effected hydraulically; or both the clamping and the releasing of the change-over elements is effected purely hydraulically, by increasing or removing the hydraulic pressure, under the control of a distributor control or switching device 15.

The clamping of the toothed disk 28 is released by the distribution control device 15 which is formed with conventional electrical and hydraulic control elements and which receives from a pump 14 the hydraulic medium (such as hydraulic fluid) under the required pressure. This medium is fed to the toothed disk 28 via an hydraulic fluid line 29, the clamping unit 22 and a clamping strap 30. In the diagrammatically illustrated embodiment of FIG. 2, this is effected by removing the hydraulic oil pressure from the chamber 31, for example, through directional control valves located in the distributor control device 15, in order to release the plunger 32. On the other hand, in the alternate embodiment shown in FIG. 7, this is achieved by building up hydraulic oil pressure and thereby rendering the spring force ineffective.

Simultaneously, another hydraulic oil line 33 branching from the hydraulic oil line 29 effects the release of the clamping of the turn-over cylinder carriage 27 and the release of the clamping at the twin wheel of the turn-over cylinder the (toothed gear 25 and the gear rim 26). This occurs by means of the clamping devices 16 and 17, diagrammatically illustrated in FIG. 2, through the removal or reduction of the hydraulic oil pressure within the pressure chambers 34 and 35 and, consequently, through the release of the pistons 36 and 37 via the distribution control device. 15.

In the alternative, hereinafter further described embodiments of these clamping devices 38 and 39 shown in FIGS. 3 and 4, the releasing effect is generated by building-up hydraulic pressure potentials. In this regard, cup or plate springs 40 and 41 are used for clamping the change-over elements 25, 26 and 27, while the release of the clamping of these change-over elements 25, 26 and 27 is effected hydraulically.

In the specific embodiment shown in FIG. 1, an eventual change-over or conversion of the machine to different format sizes is achievable by turning the posterior sheet supporting segments 7. As a matter of fact, a reverse mode of operation would also be possible in principle, i.e. the anterior sheet supporting segments 6 could be turned. As shown in FIG. 2, an additional control line 42 branched-off from the hydraulic oil line 29 acts, therefore, upon a clamping device 21 for the purpose of effecting an eventual format change-over of the machine, and, by removing the hydraulic pressure via clamping straps 43 and 44 and disks 45 and 46, releases the clamping connection of the movable delivery drum part i.e. the clamping connection of the turnable posterior segments 7 on which the suction device 9 is fastened (note FIG. 1).

Because the position of the gripper device 4 for the leading edge of the sheet must then remain unchanged relative to the gripper bar 2 of the guiding drum 1 (note FIG. 1), a pressure chamber 91 of an arresting device 20 is subjected to pressure via the same control line 42, whereby, due to the aforementioned removal of the hydraulic pressure, a cylinder piston 48 provided with a recess 47 received therein, due to the biasing action of a compression spring 49, a mandrel 50 fastened to the anterior segments 6, assuring the arrest of the piston 48 during the format change-over operation.

Two additional control lines 51 and 52 extending from the distributor control device 15 lead to a double-acting cylinder 53 arranged at the turn-over cylinder 11. The piston 54 of this cylinder 53, via a lever 55 secured to the turn-over cylinder carriage 27, effects a relative adjustment of the turn-over cylinder carriage 27, in order to match the swiveling movement of the gripper elements of the tongs grippers 10, through the adjustment of the gripper control parts to the corresponding tongs gripper-control cams.

After the necessary operating steps have been performed, such as adjustment of the phase of the gripper device 10 of the turn-over cylinder 11 via the twin wheel thereof (the toothed wheel or gear 25 and the gear rim 26), as well as the adjustment of the posterior sheet-supporting segments 7 together with the suction device 9 attached thereto and used for the format change, followed by adjustment of the gripper opening cams at both the delivery cylinder 8 and the turn-over cylinder 11, the clamping of the respective positions for the continuous printing in the first-forme and perfector mode can be initiated by building up, in the embodiment shown in FIG. 2, the hydraulic oil pressure in the respective clamping elements.

Figure 3:
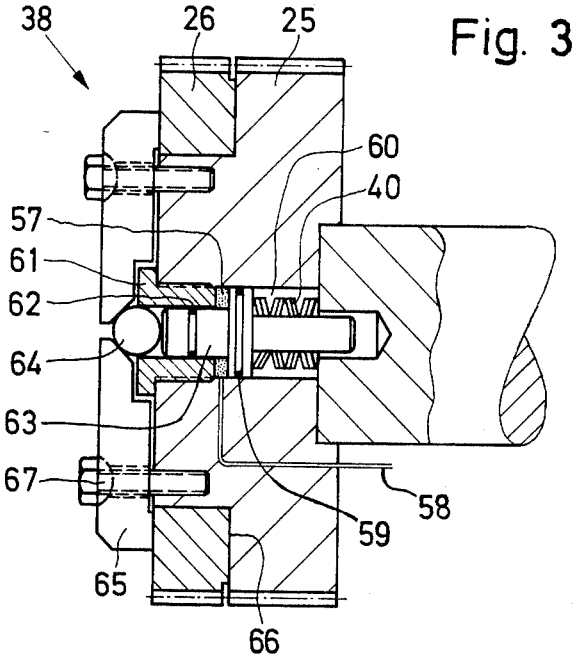
FIG. 3 is an enlarged fragmentary view of FIG. 2 showing a device for clamping a twin wheel of the turn-over cylinder.
Figure 4:
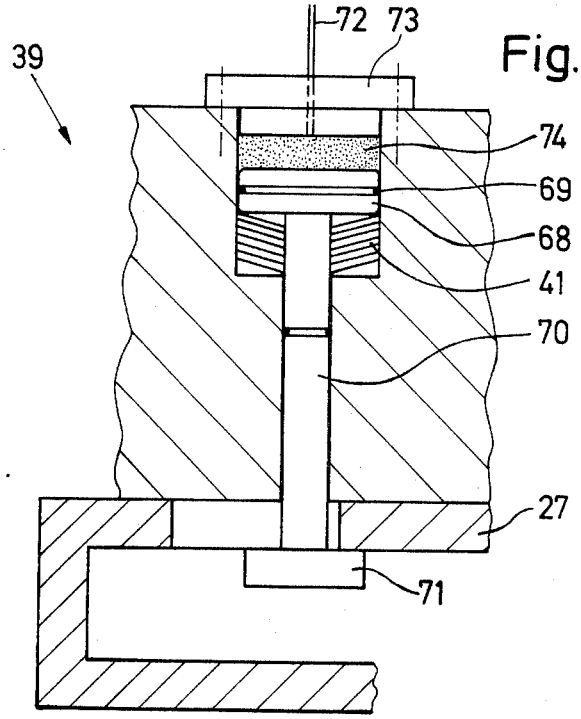
FIG. 4 is also an enlarged fragmentary view of FIG. 2 showing a device for clamping a carriage or slide of the turn-over cylinder.

In the case of the alternatively constructed clamping devices 38, 39 and 82, shown in FIGS. 3, 4 and 7, wherein the clamping of the change-over elements is effected through spring elements 40, 41 and 42, the opposite method must be selected i.e. removal or reduction of the hydraulic oil pressure.

FIG. 3 shows the clamping device 38 for clamping to the twin wheel of the turn-over cylinder 11 and formed of the toothed wheel or gear 25 and the gear rim 26. An essential element of this clamping device 38 is a piston 59 which is biased on one side, by cup springs 40 and subjected, on the other side, by pressure of hydraulic oil delivered through a control line 58 terminating in the pressure chamber 57. A bore 60 formed in the toothed wheel or gear 25 holds, additionally, a threaded bushing 61 within which a piston rod 63 provided with a packing ring 62 moves longitudinally, pressing the gear rim 26, via a thrust piece 64 and three clamping jaws uniformly distributed over the circumference of the gear rim 26, against an end face 66 of the toothed wheel or gear 25. Retaining screws 67 determine the pressing force through the position thereof and through the lever arm ratio resulting therefrom, respectively.

The clamping device 38 illustrated in FIG. 4 for clamping the carriage or slide 27 of the turn-over cylinder 11 provides clamping action by means of disk springs 41 in an embodiment different from that of FIG. 2. A piston 68 provided with a packing ring 69 moves, together with a piston rod 70 secured thereto and a clamping head 71 serving to clamp the turn-over cylinder carriage or slide 27, into the clamping and the releasing position, relatively, depending upon the force or pressure conditions or relationships prevailing.

The force or pressure relationships are determined, in this regard, by the hydraulic oil flowing via a control line 72 into an hydraulic chamber 74 defined by a piston 68 and a cover 73.

FIGS. 5 and 6 show, in diagrammatic representations, additional clamping devices 75 and 76, respectively, for clamping the carriage or slide 27 of the turn-over cylinder 11. One or two plungers 78, 79 are subjected to hydraulic pressure via a control line 77. These plungers 78, 79 affect the clamping of the turn-over cylinder carriage or slide 27 by means of correspondingly supported clamping jaws 80, 81.

FIG. 7 shows an embodiment of a clamping device 82 different from that shown in FIG. 1, which serves for clamping the toothed disk 28 and for clamping the disk 45, 46 for the format adjustment of the delivery cylinder 8, respectively.

In this regard the clamping power is provided by the resilient or spring force of cup springs 42 which act upon a piston 84 provided with a sealing or packing ring 83 and having a piston rod 85 which effects the clamping of the toothed disk 28 and the disk 45, respectively, via the clamping strap 30 and 43, respectively, and a retaining screw 86.

The piston rod 85 extends through a threaded member 87 which is secured in a suitable recess 88 and which, together with the piston 84, encloses a pressure or hydraulic chamber 89 which, via a control line 90, can be provided with pressure oil in order to be able to release the clamping effect by acting against or opposite the resilient or spring force of the cup springs 42.

With respect to the hydraulic oil lines which provide the aforedescribed individual control and clamping devices with hydraulic fluid, it is believed to be readily apparent that the transition from the stationary section thereof to the section rotating with the cylinders 8 and 11 is effected by means of suitable coupling devices 92, 93 of conventional construction.

As noted generally hereinbefore, this invention is not restricted to the specific turn-over device, described, for example, herein in order to explain the function and operational characteristics of the invention, but also encompasses different types of sheet turn-over devices which can be realized in a relatively simple manner, thus creating a multitude of different possible configurations.

In addition thereto, it is conceivable and quite readily feasible to separate the hydraulic oil lines of the clamping devices for conversion between first-forme and perfector operations as well as for format adjustment in such a manner that the appertaining clamping and releasing operations can be carried out, selectively, and sequentially, respectively. Furthermore, the counter-pressure for the releasing operation, which is required only for a short period of time, could also be applied pneumatically instead of hydraulically, especially when mechanical elements, such as cup or plate springs, for example, are used for clamping the change-over elements.

The foregoing is a description corresponding, in substance, to German application G No. 83 19 431.2, dated July 6, 1983, international priority of which is being claimed for the instant application, and which is hereby made part of this application. Any material discrepancies between the foregoing specification and the specification of the aforementioned corresponding Germany application are to be resolved in favor of the latter.

There is claimed:

1. A device for selectively converting, for either first-forme alone or combined first-forme and perfector printing, a turn-over device arranged between individual printing units of a sheet-fed rotary printing machine, comprising adjustment elements for the turn-over device, hydraulically actuable control and clamping devices operatively connected with the turn-over device for performing controlling and clamping operations on the respective adjustment elements, said control and clamping devices including self-acting mechanical operating means for clamping said adjustment elements for the printing operation, hydraulic operating means for releasing said clamping of said adjustment elements preparatory to effecting a conversion of the turn-over device, central switching means via which said hydraulically actuable control and clamping devices are operable and are controllable in a given sequence, and at least one control line extending from said central switching means and connected to said hydraulic operating means for initiating the first-forme and perfector printing conversion and for format adjustment.

2. A device for selectively converting, for either first-forme alone or combined first-forme and perfector printing, a turn-over device arranged between individual printing units of a sheet-fed rotary printing machine, comprising adjustment elements for the turn-over device, hydraulically actuable control and clamping devices operatively connected with the turn-over device for performing controlling and clamping operations on the respective adjustment elements, said hydraulically actuable devices being operative for clamping and controlling said adjustment elements for the printing process and including hydraulic operating means for releasing said clamping by releasing said clamping by relieving the hydraulic pressure, central switching means via which said hydraulically actuable control and clamping devices are operable and are controllable in a given sequence, and at least one control line extending from said central switching means and connected to said hydraulic operating means for initiating the first-forme and perfector printing conversion and for format adjustment.

3. A device for selectively converting, for either first-forme alone or combined first-forme and perfector printing, a turn-over device arranged between individual printing units of a sheet-fed rotary printing machine, comprising adjustment elements for the turn-over device, hydraulically actuable control and clamping devices operatively connected with the turn-over device for performing controlling and clamping operations on the respective adjustment elements, the turn-over device being a cylinder having a twin wheel connected thereto having a gear and a gear rim disposed thereon, and including a cylinder piston for clamping said twin wheel, said piston having a piston rod actuable via a thrust member upon clamping jaws serving as levers for pressing said gear rim against an end face of said gear.

4. Selective converting device according to claim 3, including spring elements via which the clamping force for clamping said twin wheel of said turn-over cylinder is applied, and a pressure chamber having an hydraulic control line connected thereto for releasing the clamping of said twin wheel.

5. Selective converting device according to claim 3, including grippers carried by the turn-over device, and means for adjusting swinging movement and opening and closing behavior of said grippers, said adjusting means comprising a carriage axially slideable on the turn-over device.

6. A device for selectively converting, for either first-forme alone or combined first-forme and perfector printing, a turn-over device arranged between individual printing units of a sheet-fed rotary printing machine, comprising adjustment elements for the turn-over device, hydraulically actuable control and clamping devices operatively connected with the turn-over device for performing controlling and clamping operations on the respective adjustment elements gripppers carried by the turn-over device, means for adjusting swinging movement and opening and closing behavior of said grippers, said adjusting means comprising a carriage axially slideable on the turn-over device, and single-acting cylinder positions for clamping said carriage of the turn-over device, said cylinder piston having piston rods and clamping heads secured at respective ends thereof via which said carriage is pressable against the turn-over device.

7. A device for selectively converting, for either first-forme alone or combined first-forme and perfector printing, a turn-over device arranged between individual printing units of a sheet-fed rotary printing machine, comprising adjustment elements for the turn-over device, hydraulically actuable control and clamping devices operatively connected with the turn-over device for performing controlling and clamping operations on the respective adjustment elements, grippers carried by the turn-over device, means for adjusting swinging movement and opening and closing behavior of said grippers, said adjusting means comprising a carriage axially slideable on the turn-over device, spring elements for applying spring force for clamping said carriage, and a pressure chamber having an hydraulic control line connected thereto for counter-acting the spring force.

8. A device for selectively converting, for either first-forme alone or combined first-forme and perfector printing, a turn-over device arranged between individual printing units of a sheet-fed rotary printing machine, comprising adjustment elements for the turn-over device, hydraulically actuable control and clamping devices operatively connected with the turn-over device for performing controlling and clamping operations on the respective adjustment elements, grippers carried by the turn-over device, means for adjusting swinging movement and opening and closing behavior of said grippers, said adjusting means comprising a carriage axially slideable on the turn-over device, and clamping jaws for the clamping of said carriage, plungers actuable by separate control lines being cooperatively engageable with said clamping jaws for forming a force-locking connection between said carriage and the turn-over device.

9. A device for selectively converting, for either first-forme alone or combined first-forme and perfector printing, a turn-over device arranged between individual printing units of a sheet-fed rotary printing machine, comprising adjustment elements for the turn-over device, hydraulically actuable control and clamping devices operatively connected with the turn-over device for performing controlling and clamping operations on the respective adjustment elements, respective discs being mounted adjacent end faces of a delivery cylinder disposed upstream of the turn-over device in travel direction of the sheets, said discs serving for adjusting a cam of the delivery cylinder and for format adjustment of a suction device on the delivery cylinder, respectively, and single-action clamping units actuable via clamping straps acting as levers for clamping the respective discs.

10. Selective converting device according to claim 9, including spring elements in biasing engagement with a piston via which a clamping force is applicable for clamping said discs, and including a pressure chamber having an hydraulic control line connected thereto for releasing the clamping of said discs.

11. A device for selectively converting, for either first-forme alone or combined first-forme and perfector printing, a turn-over device arranged between individual printing units of a sheet-fed rotary printing machine, comprising adjustment elements for the turn-over device, hydraulically actuable control and clamping devices operatively connected with the turn-over device for performing controlling and clamping operations on the respective adjustment elements, grippers carried by the turn-over device, means for adjusting swinging movement and opening and closing behavior of said grippers, said adjusting means comprising a carriage axially slideable on the turn-over device, and a double-acting hydraulic cylinder for axially displacing said carriage parallel to a longitudinal axis of said turn-over device, said cylinder having a piston actuable upon said carriage via a lever secured to said carriage.

12. A device for selectively converting, for either first-forme alone or combined first-forme and perfector printing, a turn-over device arranged between individual printing units of a sheet-fed rotary printing machine, comprising adjustment elements for the turn-over device, hydraulically actuable control and clamping devices operatively connected with the turn-over device for performing controlling and clamping operations on the respective adjustment elements, a delivery cylinder being disposed upstream of the turn-over device in travel direction of the sheets, and an arresting device for securing part of said delivery cylinder in connection with a format adjustment of the machine, said arresting device comprising a cylinder piston formed with an end recess engageable over a mandrel extending from said delivery cylinder, said piston being actuable at one side thereof by hydraulic fluid receivable in an hydraulic chamber at said side from an hydraulic control line connected therewith and, upon release of pressure from the hydraulic fluid, being biased by spring force of a compression spring acting on the other side of said piston for urging said end recess of said piston about said mandrel.

* * * * *